US012098562B2

(12) United States Patent
Watanabe

(10) Patent No.: US 12,098,562 B2
(45) Date of Patent: Sep. 24, 2024

(54) BUILDING AND COMPLEX BUILDING

(71) Applicant: POWER GENERATION JAPAN CO., LTD., Gifu (JP)

(72) Inventor: Masaki Watanabe, Gifu (JP)

(73) Assignee: POWER GENERATION JAPAN CO., LTD., Gifu (JP)

( * ) Notice: Subject to any disclaimer, the term of this patent is extended or adjusted under 35 U.S.C. 154(b) by 265 days.

(21) Appl. No.: 17/578,132

(22) Filed: Jan. 18, 2022

(65) Prior Publication Data

US 2023/0003040 A1 Jan. 5, 2023

Related U.S. Application Data

(63) Continuation of application No. PCT/JP2021/026908, filed on Jul. 19, 2021.

(30) Foreign Application Priority Data

Jun. 30, 2021 (JP) ..... 2021-108763

(51) Int. Cl.
*E04H 1/04* (2006.01)

(52) U.S. Cl.
CPC ..... *E04H 1/04* (2013.01)

(58) Field of Classification Search
CPC .... E04H 1/04; E04H 3/00; E04H 3/02; E04H 3/04; E04H 6/00; E04H 6/10
USPC ..... 52/236.3
See application file for complete search history.

(56) References Cited

U.S. PATENT DOCUMENTS

| | | | | |
|---|---|---|---|---|
| 5,749,186 | A * | 5/1998 | Kaufman | E04H 6/10 52/174 |
| 6,209,270 | B1 * | 4/2001 | Johnston | E04H 14/00 52/33 |
| 7,866,910 | B2 * | 1/2011 | Gustafson | E01C 1/002 404/1 |
| 8,402,698 | B1 * | 3/2013 | Wang | E04H 6/10 52/29 |
| 9,267,306 | B2 * | 2/2016 | Suhami | E04H 14/00 |
| 10,450,739 | B1 * | 10/2019 | Schlagel | E04H 1/04 |
| 11,466,470 | B1 * | 10/2022 | Bramlett | E04B 1/20 |
| 11,530,547 | B2 * | 12/2022 | McUtchen | E04C 5/08 |
| 2018/0002938 | A1 * | 1/2018 | Stewart | E04H 1/04 |
| 2019/0119935 | A1 * | 4/2019 | Zheng | E04H 14/00 |

FOREIGN PATENT DOCUMENTS

| | | |
|---|---|---|
| JP | 2001-262855 A | 9/2001 |
| JP | 3221158 U | 5/2019 |

* cited by examiner

*Primary Examiner* — James J Buckle, Jr.
(74) *Attorney, Agent, or Firm* — Rimon P.C.

(57) ABSTRACT

To provide a building for an apartment house that allows a vehicle to be parked adjacent to a residential part efficiently. A building includes: a plurality of housing parts formed on one floor of a building body, in each of which a resident H resides, and each including two or more residential floors and including a resident entrance part that allows entry and exit of the resident H and a service entrance part disposed on a residential floor that is different from the residential floor on which the resident entrance part is disposed; a housing-part parking part that communicates with the service entrance part of each housing part, the housing-part parking part being disposed adjacent to the housing part to enable a vehicle C.

2 Claims, 5 Drawing Sheets

BUILDING AND COMPLEX BUILDING

CROSS FIELD

This application is continuation of International Application No. PCT/JP2021/26908, filed on Jul. 19, 2021, which claims the benefit of Japanese Patent Application No. 2021-108763, filed on Jun. 30, 2021, the entire contents of each are hereby incorporated by reference.

TECHNICAL FIELD

The present invention relates to a building for an apartment house in which a vehicle can be parked in a housing part, and to a complex building in which a commercial facility part is provided in addition to a housing part, for example.

BACKGROUND ART

In a common apartment house according to the related art, parking spaces in which vehicles can be parked are disposed adjacently outside the building, or disposed in a concentrated manner in lower layers of the building.

There is also known a device in which vehicles are transported by an elevator to a parking facility that is adjacent to a residential area, as disclosed in Patent Literature 1 and Patent Literature 2, for example.

CITATION LIST

Patent Literature

Patent Literature 1: JP 2001-262855 A
Patent Literature 2: JP 3221158 U

SUMMARY OF INVENTION

Technical Problem

In the device in which vehicles are transported using an elevator, however, the vehicles must be transported to each apartment, one vehicle at a time, and therefore congestion is inconveniently caused during commuting hours, for example. In the configuration according to the related art, the maintenance work for the elevator for the vehicles is complicated, which significantly increases the burden on the management.

It is an object of the present invention to provide a building with a simple structure that is safe and highly convenient.

It is also an object of the present invention to provide a complex building with a simple structure that is safe and highly convenient.

Solution to Problem

The present invention (first invention) provides a building including one building body, the building body including a plurality of floors, on each of which a plurality of housing parts are disposed, each of the housing parts including a residential space part in which a resident resides and a housing-part parking part that enables a vehicle that the resident uses to be parked therein, characterized in that: the housing part includes two or more residential floors in the residential space part, at least one of the residential floors being provided with a resident entrance part that enables entry and exit of the resident between inside of the housing part and outside of the housing part, and a residential floor that is different from the residential floor provided with the resident entrance part being provided with the housing-part parking part which communicates with the residential space part of the housing part, and a parking entrance/exit part that enables entry and exit of the vehicle between inside of the housing-part parking part and the outside of the housing part; the building body further includes a housing part-side vehicle road part formed over a plurality of floors of the building body to enable vehicles to pass therethrough, the housing part-side vehicle road part connecting between outside of the building body and each parking entrance/exit part, and a housing part-side pedestrian road part formed over a plurality of floors of the building body to enable residents to walk thereon, the housing part-side pedestrian road part connecting between the outside of the building body and each resident entrance part; and a height of the housing part-side vehicle road part and a height of the housing part-side pedestrian road part are different from each other on one floor of the building body, and the housing part-side vehicle road part and the housing part-side pedestrian road part face an identical space at the different heights.

In such a configuration, the housing-part parking is formed in each housing part. Therefore, the resident of each housing part can go out on the vehicle that he/she owns without getting out of the housing part. Similarly, the resident can come home on the vehicle to a place that is close to the residential space also when he/she comes back from the outside. High safety can be achieved with a significantly low risk of an accident, since the housing part-side vehicle road part exclusively for vehicles and the housing part-side pedestrian road part exclusively for residents are disposed away from each other in one building body. In particular, significantly high safety can be achieved compared to the configuration in which the housing part-side vehicle road part and the housing part-side pedestrian road part are simply separated from each other by a fence but are adjacent to each other at the same height, since the housing part-side vehicle road part and the housing part-side pedestrian road part are at different heights. On the other hand, a configuration in which the housing part-side vehicle road part and the housing part-side pedestrian road part are provided in individual tunnel structures to be completely isolated from each other is proposed, in order to enhance safety. However, such a configuration gives a strong sense of closedness, and does not readily provide a sense of openness which is obtained with common detached houses. In the present invention, however, both the two road parts face an identical space while being located at different heights. Therefore, neither pedestrians nor those who use vehicles are given a sense of closedness. For example, one can feel the air at the resident entrance part and the air at the parking entrance/exit part when he/she comes home, and can obtain a sense of security and fulfill a desire to possess a residence as well. When a fire engine as an emergency vehicle extinguishes a fire in the housing part using the housing part-side vehicle road part, water can be appropriately thrown toward the residential floor on which the resident entrance part is located.

The present invention (second invention) also provides complex building including one building body, the building body including a plurality of floors, on each of which a plurality of housing parts in which a resident resides and a commercial facility as a non-residential area are disposed, characterized by including: a commercial facility part in which the commercial facility is disposed; commercial facility part parking formed over a plurality of floors to enable a vehicle that a commercial facility user uses to be parked therein; a commercial facility part-side road part formed over a plurality of floors of the building body to enable vehicles to pass therethrough, the commercial facility part-side road part connecting between outside of the building body and the commercial facility part parking; a housing-part parking part formed in each housing part to enable a vehicle that a resident residing in each housing part uses to be parked therein; a housing part-side vehicle road part formed over a plurality of floors of the building body to enable vehicles to pass therethrough, the housing part-side vehicle road part connecting between the outside of the building body and the housing-part parking part; and a housing part-side pedestrian road part formed over a plurality of floors of the building body to enable residents to walk thereon, the housing part-side pedestrian road part connecting between the outside of the building body and a resident entrance part provided in each housing part, in which the commercial facility part-side road part and the housing part-side vehicle road part are not connected to each other in the building body to prohibit traffic of vehicles therebetween.

In such a configuration, the commercial facility part-side road part and the housing part-side motor road part are not connected to each other. Therefore, a large number of unspecified commercial facility users do not pass through the housing part-side motor road part for the housing parts, which is suitable to maintain the peace in the housing parts. A blockage of smooth passage of the vehicles of the residents can also be prevented in a situation in which the commercial facilities are congested, for example.

The present invention (third invention) provides a complex building including one building body, the building body including a plurality of floors, on each of which a plurality of housing parts and a commercial facility as a non-residential area are disposed, each of the housing parts including a residential space part in which a resident resides and a housing-part parking part that enables a vehicle that the resident uses to be parked therein, characterized by including: a commercial facility part in which the commercial facility is disposed; commercial facility part parking formed over a plurality of floors to enable a vehicle that a commercial facility user uses to be parked therein; and a commercial facility part-side road part formed over a plurality of floors of the building body to enable vehicles to pass therethrough, the commercial facility part-side road part connecting between outside of the building body and the commercial facility part parking, in which: the housing part includes two or more residential floors in the residential space part, at least one of the residential floors being provided with a resident entrance part that enables entry and exit of the resident between inside of the housing part and outside of the housing part, and a residential floor that is different from the residential floor provided with the resident entrance part being provided with the housing-part parking part which communicates with the residential space part of the housing part, and a parking entrance/exit part that enables entry and exit of the vehicle between inside of the housing-part parking part and the outside of the housing part; the building body further includes a housing part-side vehicle road part formed over a plurality of floors of the building body to enable vehicles to pass therethrough, the housing part-side vehicle road part connecting between the outside of the building body and each parking entrance/exit part, and a housing part-side pedestrian road part formed over a plurality of floors of the building body to enable residents to walk thereon, the housing part-side pedestrian road part connecting between the outside of the building body and each resident entrance part; a height of the housing part-side vehicle road part and a height of the housing part-side pedestrian road part are different from each other on one floor of the building body, and the housing part-side vehicle road part and the housing part-side pedestrian road part face an identical space at the different heights; and the commercial facility part-side road part and the housing part-side vehicle road part are not connected to each other in the building body to prohibit traffic of vehicles therebetween.

With such a configuration, as with the first invention, the resident can go out on the vehicle that he/she owns without getting out of the housing part, and can come home on the vehicle to a place that is close to the residential space. Significantly high safety can be achieved, since the housing part-side vehicle road part and the housing part-side pedestrian road part are at different heights. Both the two road parts face an identical space. Therefore, the residents are not given a sense of closedness, and can obtain a sense of security and fulfill a desire to possess a residence as well. Appropriate measures can advantageously be taken easily even in the case where an emergency vehicle passes.

Advantageous Effect of Invention

The present invention provides a simple structure that is safe and highly convenient.

DESCRIPTION OF EMBODIMENTS

A building and a complex building according to examples of the present invention will be described in detail below. The present invention is not limited to the examples described below, and may be subjected to design changes as appropriate.

Example 1

Figure 1:
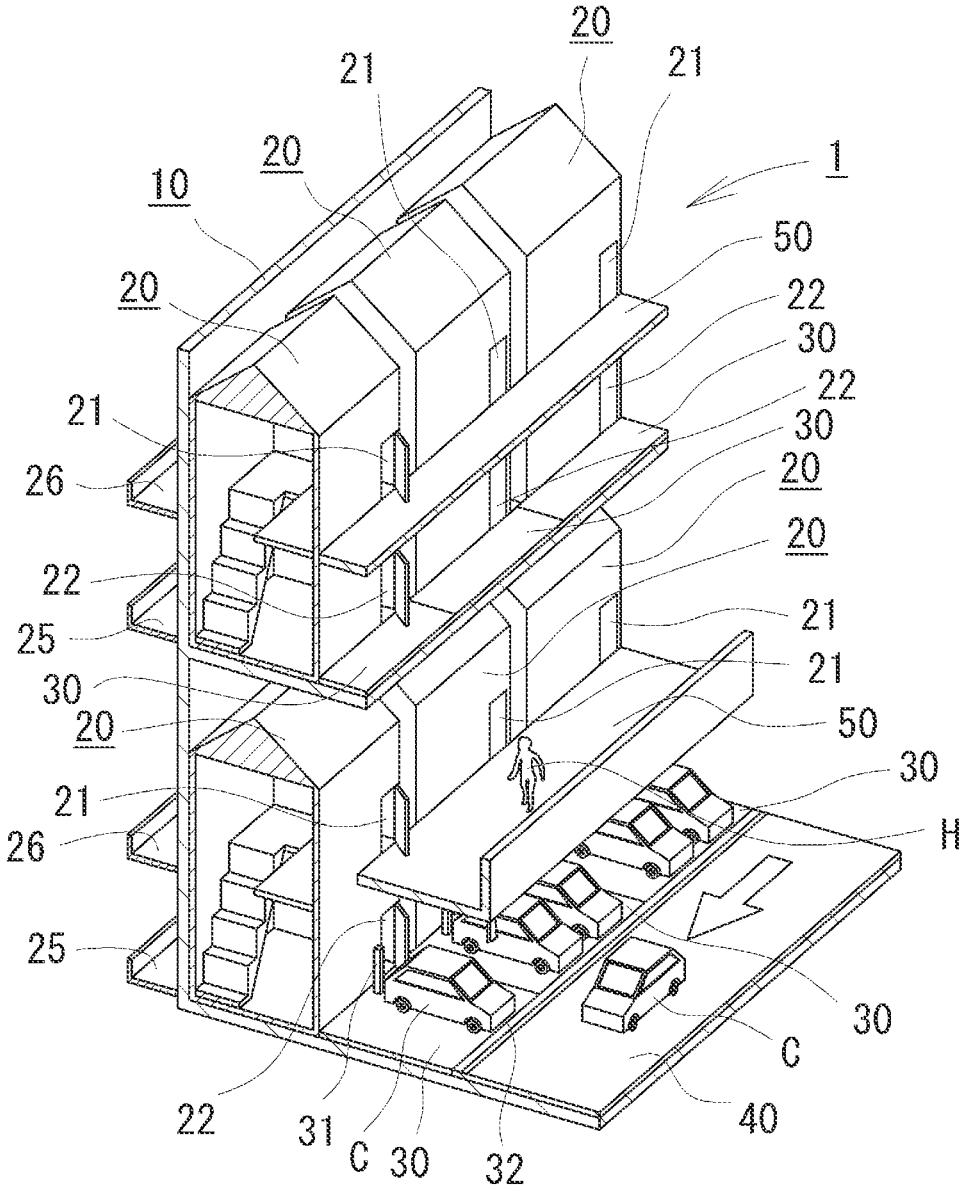
FIG. 1 illustrates a building according to example 1 with a wall part and a floor part partly omitted.
Figure 2:
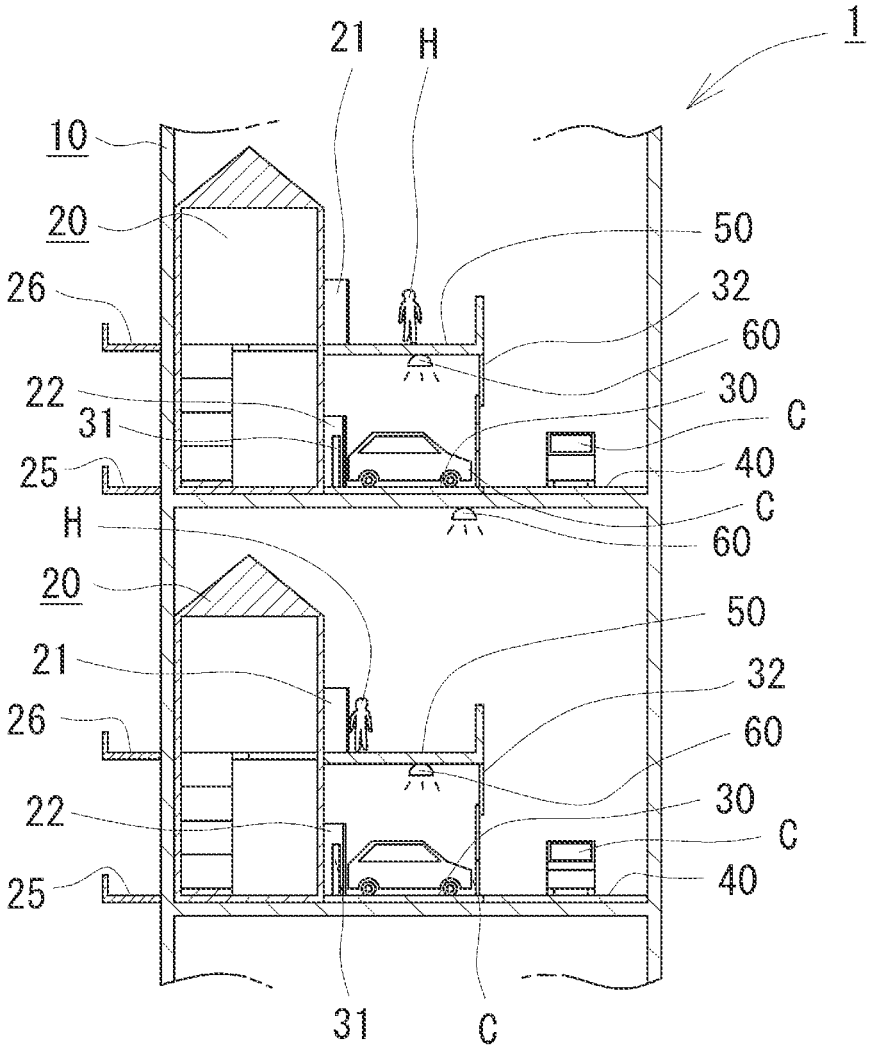
FIG. 2 is a partially enlarged vertical sectional view of the building according to example 1.
Figure 3:
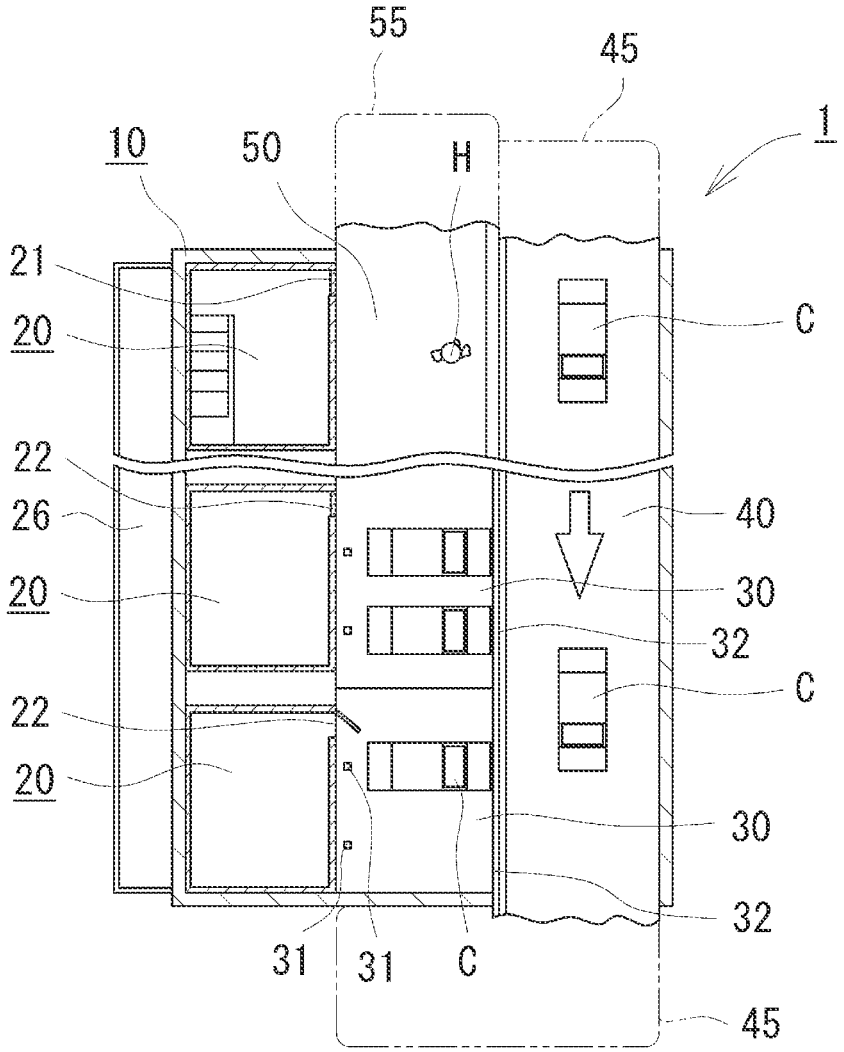
FIG. 3 is a partially enlarged lateral sectional view of the building according to example 1.

As illustrated in FIGS. 1 to 3, a building 1 includes one building body 10, and the building body 10 includes a plurality of floors. A plurality of housing parts 20, each of which a resident H resides, are arranged adjacent to each other on each floor. Each of the housing parts 20 may be owned or rented, for example, and the housing parts 20 in the building body 10 constitute separate residences.

Now, the internal structure of the housing part 20 will be described.

As illustrated in FIG. 1 etc., the housing part 20 has a plurality of residential floors for each floor of the building body 10. That is, the housing part 20 is two-storied, and the residential space in the housing part 20 has a first floor and a second floor, between which one is movable through stairs that connect between the first floor and the second floor.

A resident entrance part 21 is provided on the second floor as a residential floor. The resident entrance part 21 enables the resident to enter the housing part 20 from the outside and exit from the housing part 20 to the outside. On the other hand, a service entrance part 22 is provided on the first floor as a residential floor, and a housing-part parking part 30 is disposed via the service entrance part 22. The housing-part parking part 30 will be discussed in detail later.

Further, a first-floor balcony part 25 that faces the external environment is disposed on a first-floor part of the housing part 20 so as to project outward from the building body 10. Similarly, a second-floor balcony part 26 is disposed on a second-floor part of the housing part 20.

Next, the housing-part parking part 30 will be described.

In the present invention, each housing part 20 is individually provided with a housing-part parking part 30 that allows a resident residing in the housing part 20 to park a vehicle C that the resident uses therein. A parking entrance/exit part 32 for entry and exit of the vehicle C is formed at each housing-part parking part 30. The parking entrance/exit part 32 is provided with a shutter, for example, to be separated from the outside of the housing part 20 to constitute a so-called inner garage structure.

The housing part 20 discussed so far has two or more floors, and is separated from adjacent houses. Therefore, the housing part 20 allows one to enjoy the atmosphere of a "smart town", where he/she feels as if residing in a detached house in the building body 10 while enjoying the safety, security, and convenience of a large-scale condominium.

Now, a common part of the building body 10 will be described.

The common part of the building body 10 includes a housing part-side pedestrian road part 50 connected to the resident entrance part 21 of each housing part 20. That is, the housing part-side pedestrian road part 50 is a road formed at the height of the second floor of the housing part 20 to enable residents H to walk thereon, and is formed over a plurality of floors of the building body 10. That is, the housing part-side pedestrian road part 50 connects the inside of the building body 10 and the external environment, and enables easily moving to another floor when an elevating part such as an elevator (not illustrated) is provided.

The common part of the building body 10 further includes a housing part-side vehicle road part 40 formed to enable vehicles to pass therethrough. The housing part-side vehicle road part 40 is formed along the plurality of housing parts 20 on one floor, and is continuous with the housing-part parking part 30 of each housing part 20 on the first floor. Further, the housing part-side vehicle road part 40 is formed over a plurality of floors of the building body 10. That is, the housing part-side vehicle road part 40 is provided with a vehicle connection part 45 such as a slope to enable vehicles to move to and from upper and lower floors of the building body 10, and enables vehicles to go to and come from the outside of the building body 10.

That is, the resident H who went out on a vehicle can come home by entering the building body 10 on the vehicle C, reaching his/her housing part 20 using the housing part-side vehicle road part 40, and parking the vehicle C in the housing-part parking part 30 in the housing part 20. As a matter of course, the resident H can easily go out using the housing part-side vehicle road part 40. The housing part-side vehicle road part 40 also enables passage of emergency vehicles such as fire engines and ambulances, and enables passage of vehicles of moving companies and delivery companies.

The housing part-side vehicle road part 40 on each floor is formed to allow one-way traffic only, and therefore the vehicles C can be prevented from facing each other to cause congestion in the building body 10, and a layout that can secure a large residential space is achieved.

The housing part-side vehicle road part 40 enables passage of vehicles only, and does not enable passage of pedestrians. Thus, the residents H pass using the housing part-side pedestrian road part 50 to go out on foot.

The housing part-side pedestrian road part 50 is disposed at the height corresponding to the second-floor part of the housing part 20. Therefore, the height of the housing part-side pedestrian road part 50 is different from the height of the housing part-side vehicle road part 40 which is disposed at the height corresponding to the first-floor part. Thus, flow lines of the pedestrians and the vehicles do not cross each other in the building body 10, and minor collisions etc. between the pedestrians and the vehicles can be effectively prevented in the building body 10. On the other hand, the housing part-side vehicle road part 40 and the housing part-side pedestrian road part 50 face the same space on the same floor, and are not completely separated from each other. Therefore, communication can be made between the housing part-side vehicle road part 40 and the housing part-side pedestrian road part 50, and an environment that provides both a sense of openness and a sense of security is achieved.

The following features may be added to the configuration discussed so far.

The resident H may have a wireless key, and unlock an entrance/exit gate to the building 1 using the wireless key when the vehicle C enters the housing part-side vehicle road part 40 from the outside. This improves the function of preventing crimes in the building 1. The means for unlocking the gate may also use authentication with the number plate of the vehicle, for example, besides the wireless key. On the other hand, delivery vehicles etc. which are not used by the resident H may be enabled to enter the housing part-side vehicle road part 40 after passing through an inspection performed by a security guard etc. at an entrance provided separately, by way of example.

A configuration in which an automatic washing system that washes the undercarriage of vehicles is disposed on a path for entering the housing part-side vehicle road part 40 from the outside is proposed. This prevents contamination of the housing part-side vehicle road part 40, and decreases dirt etc. that enters the housing part 20 from the housing part-side vehicle road part 40.

The atmospheric environment in the building body 10 can be kept comfortable by enabling only electric vehicles (EVs) to enter and park in the building body 10.

Accordingly, a configuration in which a charger 31 for EVs is disposed in each housing-part parking part 30 is proposed. In the present example, two vehicles C can be parked in each housing-part parking part 30, and therefore it is desirable that the charger 31, which suffices for charging two vehicles, should be disposed in each housing-part parking part 30 in this case.

A configuration provided with emergency electric power supply means including a control circuit is proposed, the control circuit being configured to supply electric power to the housing part 20 from the vehicle C parked at the housing-part parking part 30 in the case where a power outage is caused in the building 1.

The sunlight is not likely to reach the housing-part parking part 30, the housing part-side vehicle road part 40, the housing part-side pedestrian road part 50, etc. in the case where such parts are disposed deep in the building body 10. Thus, introduction of a solar lighting system 60 that illuminates such spaces with external light using optical fibers or light guide ducts in which mirrors are disposed is proposed. A configuration that allows pedestrians to walk on the housing part-side pedestrian road part 50 in an environment that is similar to the external environment, in particular, using artificial sunlight LEDs linked to the brightness of the environment external to the building body 10 is also proposed.

The foundation structure of the housing part 20 may be integrated with the building body 10, or may be constructed separately from the building body 10. The housing parts 20 may all be formed with the same configuration, or may be formed with different configurations, such as the housing parts 20 on a predetermined floor being two-storied while the housing parts 20 on another floor are three-storied, for example. As a matter of course, all the housing parts 20 may be constructed with different configurations.

A configuration in which a seismic isolation structure system is introduced between the building body 10 and each housing part 20 to further improve the seismic isolation function in combination with the seismic isolation structure system of the building body 10 is also proposed.

Example 2

A complex building 2 according to example 2 will be discussed in detail below. Components that are similar to those according to example 1 are denoted by the same reference signs to omit description.

Figure 4:
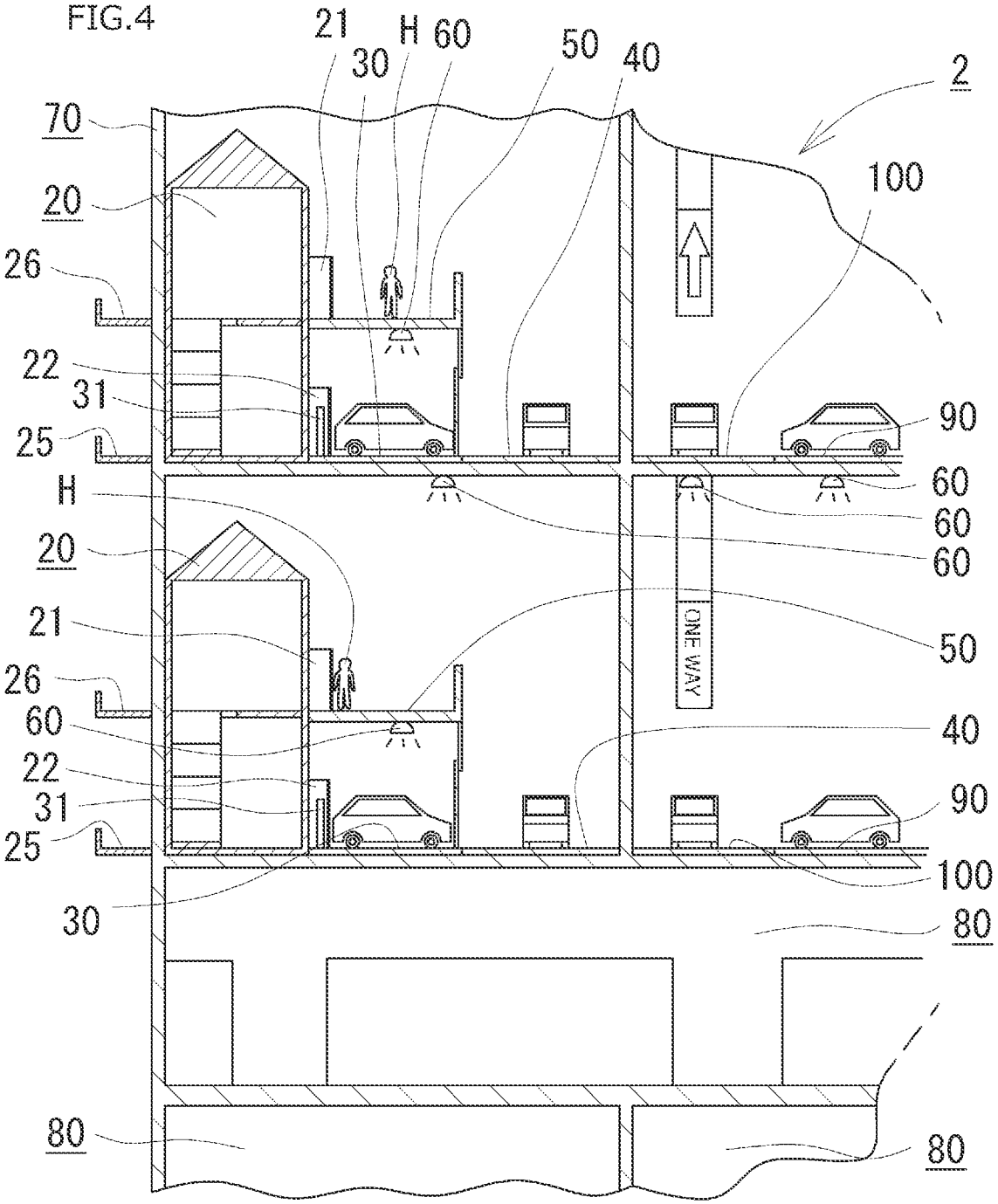
FIG. 4 is a partially enlarged vertical sectional view of a complex building according to example 2.
Figure 5:
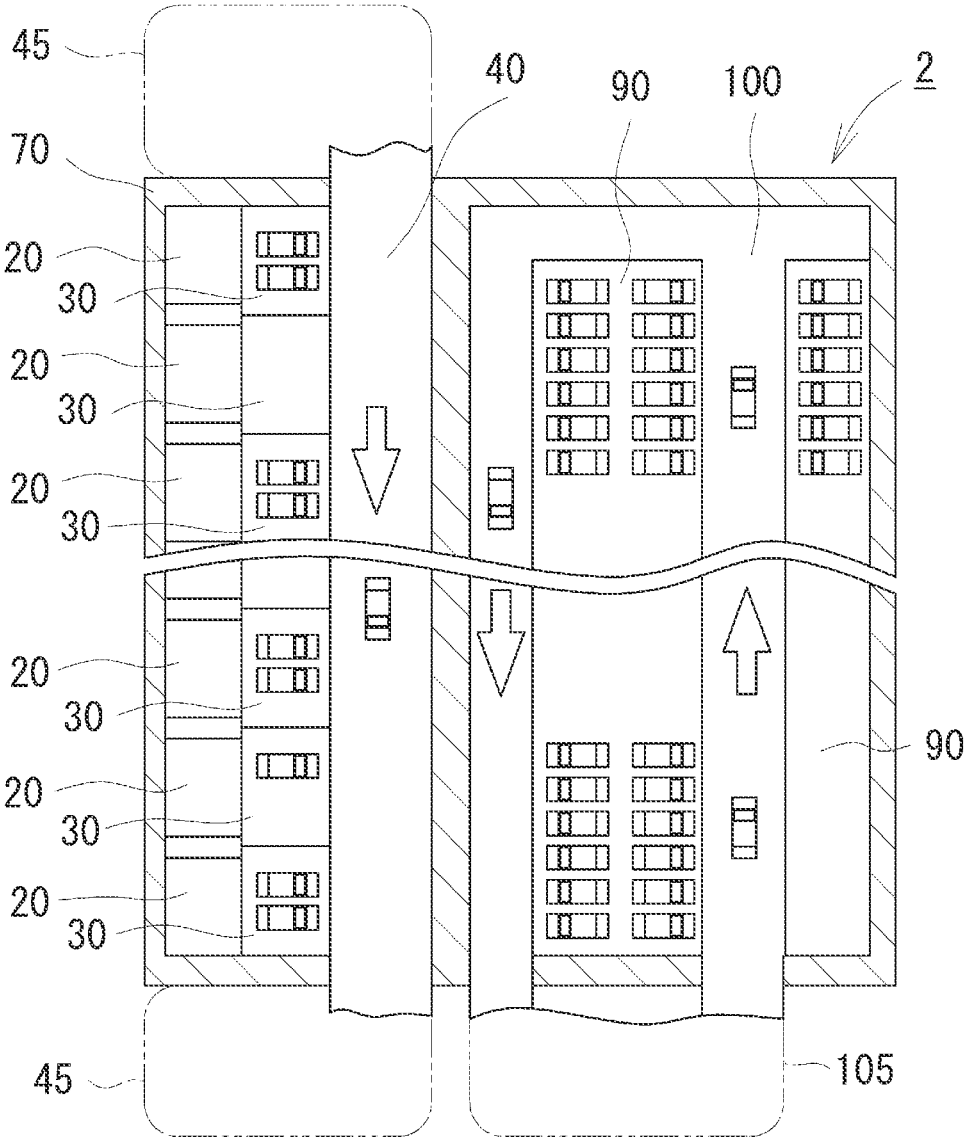
FIG. 5 is a partially enlarged lateral sectional view of the complex building according to example 2.

In the complex building 2, as illustrated in FIGS. 4 and 5, commercial facility parts 80 are formed on predetermined floors of a building body 70, and commercial facilities etc. are disposed in the commercial facility parts 80.

Commercial facility part parking 90 is formed over a plurality of floors (upper floors in the example) of the building body 70 that are different from the floors on which the commercial facility parts 80 are formed and in different sections from the housing parts 20, the housing-part parking parts 30, the housing part-side vehicle road parts 40, and the housing part-side pedestrian road parts 50.

A commercial facility part-side road part 100 is formed in the building body 70 over a plurality of floors of the building body 70 so as to be adjacent to the commercial facility part parking 90. The commercial facility part-side road part 100 connects between the inside of the building body 70 and the outside of the building body 70, and is provided with a commercial facility part-side vehicle connection part 105 such as a slope to communicate with the commercial facility part-side road part 100 on upper and lower floors of the building body 70.

The commercial facility part-side road part 100 is formed to allow one-way traffic only. Thus, the vehicles C can be prevented from facing each other to cause congestion in the building body 70. In addition, a lean layout is achieved.

The commercial facility part-side road parts 100 and the housing part-side vehicle road parts 40 are not connected to each other in the building body 70, which does not allow traffic therebetween. The vehicle connection part 45 on the housing part 20 side and the commercial facility part-side vehicle connection part 105 are disposed individually. This prevents the vehicle C of the resident H from being caught in congestion in the commercial facility parts 80.

The following features may be added to the configuration discussed so far.

The floors on which the housing parts 20 are disposed and the floors on which the commercial facility part parking 90 and the commercial facility part-side road part 100 are disposed may be different from each other in the building body 70.

A configuration in which an automatic washing system that washes the undercarriage of vehicles is disposed on a path for entering the commercial facility part-side road part 100 from the outside is proposed. This prevents contamination of the commercial facility part-side road part 100, and decreases dirt etc. that enters the building body 70.

The atmospheric environment in the building body 70 can be kept comfortable by enabling only electric vehicles (EVs) to enter and park in the building body 70.

A configuration in which a charger for EVs is disposed in the commercial facility part parking 90 is proposed.

A configuration provided with emergency electric power supply means is proposed, the emergency electric power supply means being configured to receive supply of electric power from the vehicle C parked at the commercial facility part parking 90 in the case where a power outage is caused.

A configuration in which pedestrian traffic between the housing part-side pedestrian road part 50 and the commercial facility part 80 is enabled in the building body 70, while the commercial facility part-side road part 100 and the housing part-side vehicle road part 40 are not connected to each other to prohibit traffic therebetween, is proposed. It is desirable that only residents should be enabled to enter the housing part-side pedestrian road part 50 from the commercial facility part 80 using a card key, fingerprint authentication, face authentication, etc.

As with the example 1 described above, introduction of a solar lighting system that illuminates the commercial facility part-side road part 100 etc. with external light using optical fibers or light guide ducts in which mirrors are disposed is proposed. A configuration that allows passage in the commercial facility part 80 using artificial sunlight LEDs linked to the brightness of the environment external to the building body 70 is also proposed.

In the case where the housing part 20 has a plurality of residential floors, each floor of the complex building 2 has a sufficient height. Therefore, each floor may be provided with two or more levels or an increased number of layers, and a slope etc. may be provided to enable traffic therebetween to secure parking spaces by providing further commercial facility part parking 90 and commercial facility part-side road parts 100 on each of the levels or in each of the layers.

In the examples described above, the dimensions and shapes of the various parts are freely selectable as appropriate.

REFERENCE SIGNS LIST

1 Building
2 Complex building
10,70 Building body
20 Housing part
21 Entrance part
22 Service entrance part
25 First-floor balcony part
26 Second-floor balcony part
30 Housing-part parking
31 Charger
40 Housing part-side vehicle road part
45 Vehicle connection part
50 Housing part-side pedestrian road part

55 Pedestrian connection part
60 Solar lighting system
80 Commercial facility part
90 Commercial facility part parking
100 Commercial facility-side road part
105 Commercial facility part-side vehicle connection part
C Vehicle
H Resident

The invention claimed is:

1. A building including one building body, the building body including a plurality of floors, on each of which a plurality of housing parts are disposed, each of the housing parts including a residential space part in which a resident resides and a housing-part parking part that enables a vehicle that the resident uses to be parked therein, wherein:

each housing part includes two or more residential floors in the residential space part, wherein at least one of the residential floors is provided with a resident entrance part that enables entry and exit of the resident between inside of the housing part and outside of the housing part, and wherein another one of the residential floors that is different from the at least one of the residential floors provided with the resident entrance part is provided with the housing-part parking part which communicates with the residential space part of the housing part, and a parking entrance/exit part that enables entry and exit of the vehicle between inside of the housing-part parking part and the outside of the housing part;

the building body further includes:

a housing part-side vehicle road part formed over a plurality of floors of the building body to enable vehicles to pass therethrough, the housing part-side vehicle road part connecting between outside of the building body and each parking entrance/exit part; and a housing part-side pedestrian road part formed over a plurality of floors of the building body to enable residents to walk thereon, the housing part-side pedestrian road part connecting between the outside of the building body and each resident entrance part; and a height of the housing part-side vehicle road part and a height of the housing part-side pedestrian road part are different from each other on one floor of the building body, and the housing part-side vehicle road part and the housing part-side pedestrian road part face an identical space at different heights.

2. A complex building including one building body, the building body including a plurality of floors, on each of which a plurality of housing parts and a commercial facility as a non-residential area are disposed, each of the housing parts including a residential space part in which a resident resides and a housing-part parking part that enables a vehicle that the resident uses to be parked therein, characterized by comprising:

a commercial facility part in which the commercial facility is disposed;

commercial facility part parking formed over a plurality of floors to enable a vehicle that a commercial facility user uses to be parked therein; and a commercial facility part-side road part formed over a plurality of floors of the building body to enable vehicles to pass therethrough, the commercial facility part-side road part connecting between outside of the building body and the commercial facility part parking, wherein:

each housing part includes two or more residential floors in the residential space part, wherein at least one of the residential floors is provided with a resident entrance part that enables entry and exit of the resident between inside of the housing part and outside of the housing part, and wherein another one of the residential floors that is different from the at least one of the residential floors provided with the resident entrance part being is provided with the housing-part parking part which communicates with the residential space part of the housing part, and a parking entrance/exit part that enables entry and exit of the vehicle between inside of the housing-part parking part and the outside of the housing part;

the building body further includes:

a housing part-side vehicle road part formed over a plurality of floors of the building body to enable vehicles to pass therethrough, the housing part-side vehicle road part connecting between the outside of the building body and each parking entrance/exit part; and a housing part-side pedestrian road part formed over a plurality of floors of the building body to enable residents to walk thereon, the housing part-side pedestrian road part connecting between the outside of the building body and each resident entrance part;

a height of the housing part-side vehicle road part and a height of the housing part-side pedestrian road part are different from each other on one floor of the building body, and the housing part-side vehicle road part and the housing part-side pedestrian road part face an identical space at different heights; and the commercial facility part-side road part and the housing part-side vehicle road part are not connected to each other in the building body to prohibit traffic of vehicles therebetween.

* * * * *